US008292287B2

(12) United States Patent
Iguchi et al.

(10) Patent No.: US 8,292,287 B2
(45) Date of Patent: Oct. 23, 2012

(54) DECOLORIZING DEVICE AND METHOD FOR CONTROLLING DECOLORIZING DEVICE

(75) Inventors: Ken Iguchi, Shizuoka-ken (JP); Isao Yahata, Shizuoka-ken (JP); Takahiro Kawaguchi, Shizuoka-ken (JP); Hiroyuki Taguchi, Shizuoka-ken (JP); Hiroyuki Tsuchihashi, Shizuoka-ken (JP); Hiroyuki Taki, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 165 days.

(21) Appl. No.: 12/832,686

(22) Filed: Jul. 8, 2010

(65) Prior Publication Data

US 2011/0074086 A1 Mar. 31, 2011

Related U.S. Application Data

(60) Provisional application No. 61/226,639, filed on Jul. 17, 2009, provisional application No. 61/226,626, filed on Jul. 17, 2009.

(30) Foreign Application Priority Data

Feb. 24, 2010 (JP) ..... 2010-038331
May 20, 2010 (JP) ..... 2010-116009

(51) Int. Cl.
*B65H 3/44* (2006.01)

(52) U.S. Cl. ..... 271/9.08; 271/9.01; 271/9.07; 271/9.12

(58) Field of Classification Search ..... 271/9.01, 271/9.03, 9.07, 9.08, 9.12; 399/67, 69
See application file for complete search history.

(56) References Cited

U.S. PATENT DOCUMENTS

| | | | | |
|---|---|---|---|---|
| 5,335,903 | A * | 8/1994 | Martin et al. | 271/157 |
| 5,404,817 | A * | 4/1995 | Cuff | 101/232 |
| 5,451,039 | A * | 9/1995 | Adachi | 271/9.06 |
| 5,971,387 | A * | 10/1999 | Kita | 271/9.03 |
| 7,600,752 | B2 * | 10/2009 | Nakashima et al. | 271/258.01 |
| 7,866,654 | B2 * | 1/2011 | Ohno | 271/9.08 |
| 7,957,660 | B2 * | 6/2011 | Kaneko et al. | 399/67 |
| 7,988,142 | B2 * | 8/2011 | Sugiyama | 271/9.01 |

FOREIGN PATENT DOCUMENTS

| | | |
|---|---|---|
| JP | 09-202463 | 8/1997 |
| JP | 2009-143231 | 7/2009 |

* cited by examiner

*Primary Examiner* — Kaitlin Joerger
(74) *Attorney, Agent, or Firm* — Patterson & Sheridan, LLP

(57) ABSTRACT

According to one embodiment, a decolorizing device includes a first stacker to stack sheets to be decolorized images on the sheets, a second stacker arranged adjacent to the first stacker, wherein the sheets stacked on the first stacker is kept waiting on the second stacker in order to be decolorized the images, a pressing unit to urge the sheets stacked on the second stacker downward and keep the sheets stacked on the second stacker flat, an image decolorizing unit to decolorize the images on the sheets, and a sheet feed unit positioned on an upper surface of the pressing unit to convey the sheets pressed on the pressing unit from the second stacker to the image decolorizing unit.

21 Claims, 13 Drawing Sheets

DECOLORIZING DEVICE AND METHOD FOR CONTROLLING DECOLORIZING DEVICE

CROSS-REFERENCE TO RELATED APPLICATION

This application is based upon and claims the benefit of priority from: U.S. provisional patent application No. 61/226,639, filed on Jul. 17, 2009; and U.S. provisional patent application No. 61/226,626, filed on Jul. 17, 2009 the entire contents of each of which are incorporated herein by reference.

This application is also based upon and claims the benefit of priority from: Japanese Patent Application No. 2010-38331, filed on Feb. 24, 2010; and Japanese Patent Application No. 2010-116009, filed on May 20, 2010, the entire contents of each of which are incorporated herein by reference.

FIELD

Exemplary embodiments described herein relate to a decolorizing device for decolorizing an image formed on a sheet by an image forming apparatus and accumulating the sheet from which the image has been decolorized, and also relate to a method for controlling the decolorizing device.

BACKGROUND

More sheets are consumed as the amount of various kinds of information increases. On the other hand, sheets are recycled in order to save the resource of sheets. For example, in recycling of sheets, used sheets having image information thereon made of toners and the like are processed using a large amount of bleaching agent and water, and thus recycled sheets are manufactured. Therefore, the recycling of sheets brings about the increase in the cost of recycles sheets, which diminishes the cost effectiveness and may incur new environment pollution resulting from treatment of waste water used during regeneration of used sheets.

In view of the above circumstances, a technique has been recently developed to greatly reduce the amount of actual use of sheets. According to this technique, erasable image forming material made of resin, pigment, color fixing agent, erasing agent, and the like is used to form an image on a sheet. This formed image is decolorized from the sheet by an image decolorizing device, and a white sheet is obtained. This white sheet from which the image has been decolorized is reused multiple times. According to this technique, the overall cost relating to reuse of sheets can be reduced.

For example, an image forming apparatus having an image decolorizing function for decolorizing color of image forming material by heating a sheet and capable of preventing misuse of a reused sheet has been known.

The above-described image forming apparatus has not only the image forming function but also the decolorizing function for decolorizing an image by heat. In addition, a detecting sensor is used to detect whether a mark indicating reusable sheet is attached to a sheet or not. Therefore, even when a user stacks both of reusable sheets and nonreusable sheets on a sheet feed tray in a mixed manner, the image forming apparatus can distinguish the reusable sheets. That is, the image forming apparatus performs image decolorizing processing on sheets attached with the mark indicating reusable sheet, and does not perform image decolorizing processing on sheets without the mark.

However, in the above-described image forming apparatus having the decolorizing device, if the decolorizing device is feeding sheets placed at an insertion opening in order to perform decolorizing processing on previously-inserted sheets when the user tries to perform decolorizing processing, the user is unable to insert sheets even though the user tries to feed sheets to perform new decolorizing processing on the sheets. In other words, in the case where the image forming apparatus has only one stacker for stacking sheets which are to be subjected to decolorizing processing, the uppermost sheet of stacked sheets is fed into the image forming apparatus while decolorizing processing is performed. Therefore, during the feeding operation, the user is unable to place sheets on the stackers. In addition, in the case where the placed sheets are fed in order from a feeding opening, there is a problem in that only the upper portion of the placed sheets are always reused repeatedly, resulting in low recycling efficiency. Still more, since sheets processed by the decolorizing device are already-used sheets, the sheets could be curled. When the sheets are curled, there is a possibility that the sheets are jammed during feeding operation and the processing cannot be carried out smoothly.

DETAILED DESCRIPTION

Figure 1:
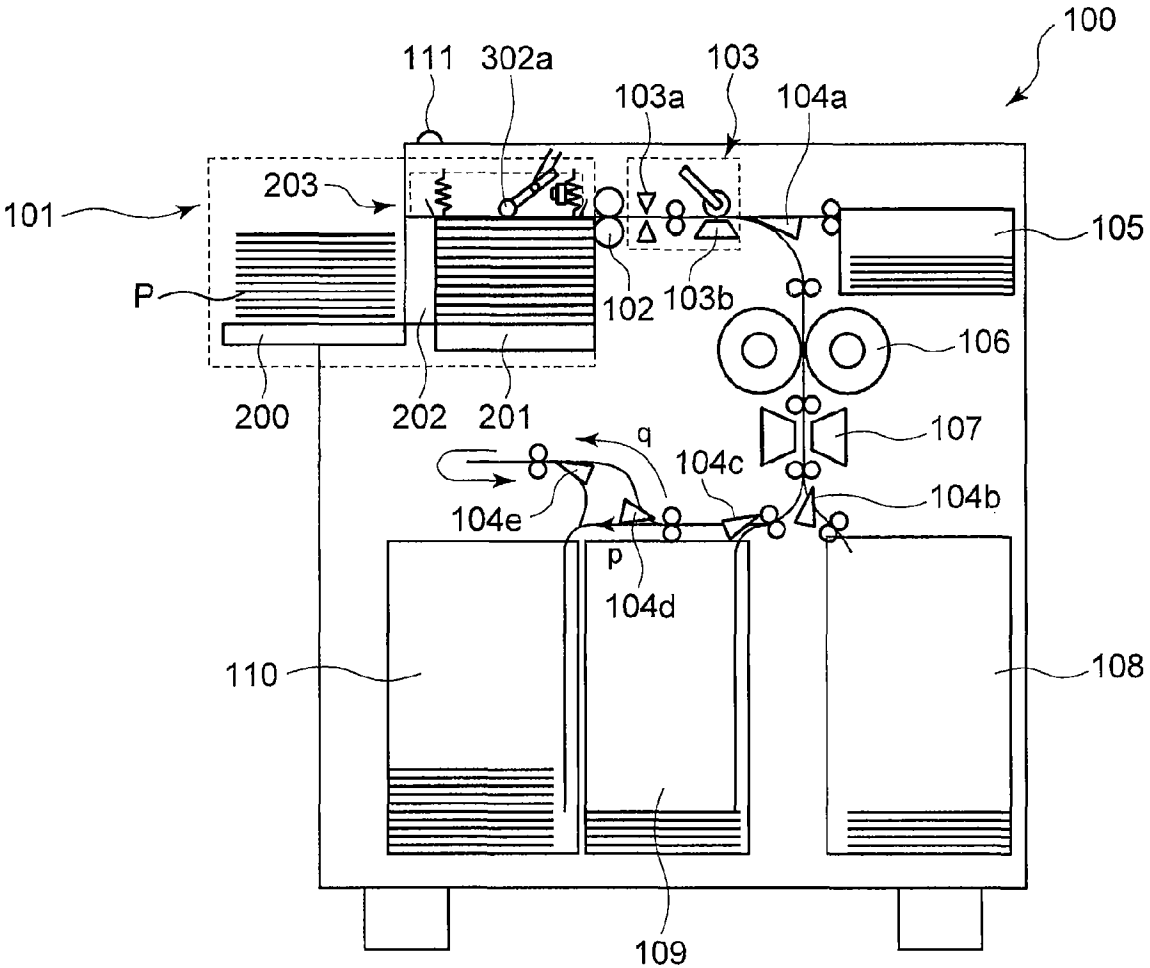
FIG. 1 is a schematic diagram illustrating a decolorizing device according to the present embodiment.

In general, according to one embodiment, there is provided a decolorizing device including: a first stacker to stack sheets to be decolorized images on the sheets; a second stacker arranged adjacent to the first stacker, wherein the sheets stacked on the first stacker is kept waiting on the second stacker in order to be decolorized the images; a pressing unit to urge the sheets stacked on the second stacker downward and keep the sheets stacked on the second stacker flat; an image decolorizing unit to decolorize the images on the sheets; and a sheet feed unit positioned on an upper surface of the pressing unit to convey the sheet pressed on the pressing unit from the second stacker to the image decolorizing unit.

The best embodiment of the decolorizing device will be hereinafter described in detail with reference to the attached drawings.

According to the present embodiment, a sheet transfer unit 101 is arranged with two stackers 200 and 201 for stacking sheets, and a partition wall 202 is arranged between the two stackers. This structure allows a user to add sheets P to the first stacker 200, even while sheets P are being fed from the second stacker 201 in order to be subjected to decolorizing processing. Further, a pressing unit 203 is arranged on the upper surface of the second stacker 201. Even when a reused sheet P is curled, the pressing unit 203 is urged upward by the sheet P, so that the sheet is kept flat.

FIG. 1 is a schematic diagram illustrating a decolorizing device. The decolorizing device 100 is adapted to heat an image formed on a sheet with erasable image forming material made of resin, pigment, color fixing agent, erasing agent, and the like, thus returning the sheet back to white.

The decolorizing device 100 includes a sheet transfer unit 101, a sheet feed roller 102, a first judging unit 103, a switching gate unit 104, a first nonreusable sheet stacker 105, an image decolorizing unit 106, a second judging unit 107, a second nonreusable sheet stacker 108, a both sides usable sheet stacker 109, a one-side usable sheet stacker 110, and a display 111.

The user can stack sheets P to be reused on the first stacker 200 exposed to the outside of the decolorizing device 100. When all the sheets P on the second stacker 201 are transferred toward the image decolorizing unit 106, and the second stacker 201 becomes empty. At this occasion, the sheet transfer unit 101 can convey the bundle of sheets P on the first stacker 200 from the first stacker 200 to the second stacker 201.

The sheet feed roller 102 is constituted by a pair of driving roller and a driven roller. The sheet feed roller 102 feeds sheets fed from the sheet transfer unit 101 in order to have the sheets subjected to decolorizing processing.

The first judging unit 103 is constituted by an ultrasonic sensor 103*a* and a sheet thickness sensor 103*b*. Before a sheet P is subjected to decolorizing processing, the first judging unit 103 judges whether the image on the sheet P can be decolorized.

The ultrasonic sensor 103*a* emits an ultrasonic wave to detect multi-feeding. The ultrasonic sensor 103*a* detects an air layer between sheets when multiple overlapped sheets P are conveyed. In other words, an ultrasonic wave is emitted, and when an air layer is detected, this means that multiple sheets P are overlapping.

The sheet thickness sensor 103*b* detects the thickness of a sheet P. For example, the sheet thickness sensor 103*b* detects multi-feeding, a folded sheet P, a torn sheet P, a staple, and the like. In other words, a sheet P having an abnormal thickness is inappropriate for reuse, and accordingly, the sheet thickness sensor 103*b* judges that the sheet P is nonreusable.

The switching gate unit 104 switches the conveying direction of the fed sheet P. For example, when the first judging unit 103 judges that a sheet is reusable, the switching gate unit 104 chooses a conveying path to image decolorizing processing. On the other hand, when the first judging unit 103 judges that a sheet is nonreusable, the switching gate unit 104 chooses a conveying path to the first nonreusable sheet stacker 105.

The first nonreusable sheet stacker 105 stacks and stores the sheet P that is judged to be nonreusable by the first judging unit 103.

The image decolorizing unit 106 is constituted by a pair of rollers. The pair of rollers generates heat having a temperature equal to or more than a certain temperature. A sheet having an image formed with erasable image forming material is passed between the pair of heated rollers, so that the image is decolorized from the sheet P, and the sheet P returns back to white. Since the image decolorizing unit 106 is constituted by the pair of rollers, the images on both sides of the sheet P can be decolorized.

The second judging unit 107 is constituted by a pair of two-dimensional CCD scanners. The CCD scanners scan both sides of a sheet P to judge whether the image has been decolorized without fault. In other words, the second judging unit 107 judges whether there is any remaining image that has not yet been decolorized by the image decolorizing unit 106. In addition, the second judging unit 107 can detect wrinkle, tear, and the like on the sheet P, which cannot be detected by the sheet thickness sensor 103*b*. The second judging unit 107 is not limited to the pair of two-dimensional CCD scanners, but may be one-dimensional scanners, CCD sensors, and the like.

A sheet P that cannot be decolorized, a torn sheet P, and the like are judged to be nonreusable by the second judging unit 107. The second nonreusable sheet stacker 108 stacks and stores the sheet P that is judged to be nonreusable by the second judging unit 107.

The both sides usable sheet stacker 109 stacks and stores the sheet P, both sides of which are judged to be reusable by the second judging unit 107.

The one-side usable sheet stacker 110 stacks and stores the sheet P, one side of which is judged to be reusable by the second judging unit 107. In the present embodiment, the upper sides of the sheets P stacked on the one-side usable sheet stacker 110 are reusable sides. In other words, the upper sides are white. Alternatively, the sheets P may be stacked such that the white side of the sheet P is oriented downward.

The display 111 indicates that sheets are transferred when the sheet transfer unit 101 transfers sheets. For example, the display 111 turns on an LED to indicate that transfer processing is performed. The display 111 is not limited to this form. Alternatively, the display 111 may use a display and the like to indicate that the transfer processing is performed.

Subsequently, the sheet transfer unit 101 will be explained in detail. The sheet transfer unit 101 includes the first stacker 200, the second stacker 201, the partition wall 202, and the pressing unit 203.

Figure 2:
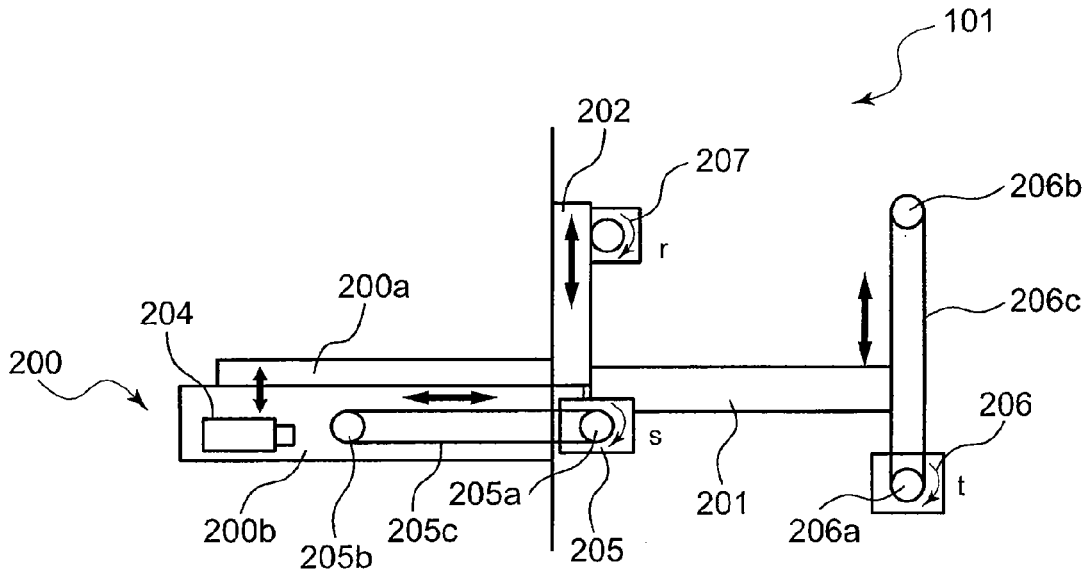
FIG. 2 is a diagram illustrating operation of a sheet transfer unit according to the present embodiment.

In the sheet transfer unit 101 as shown in FIG. 2, the first stacker 200 is arranged outside of the decolorizing device 100. The user stacks sheets P to be reused on the first stacker 200. The user can stack sheets P on the first stacker 200, even while the decolorizing device 100 is carrying out decolorizing operation of sheets stacked on the second stacker 201.

The first stacker 200 includes an upper plate 200*a* and a lower plate 200*b*. A solenoid 204 moves the upper plate 200*a* upward and downward via a link mechanism. It is only the first stacker 200 that is constituted by the upper plate 200*a* and the lower plate 200*b* and in which the upper plate 200*a* moves upward and downward. The second stacker 201 is constituted by one plate (tray). Before a sheet P is handed over, the upper plate 200*a* is at the same height as the upper surface of the second stacker 201 or at a height higher than the second stacker 201. When the sheet P is handed over to the second stacker 201, the upper plate 200*a* descends to a height lower than the upper surface of the second stacker 201. After the sheet P has been handed over, and the first stacker 200 returns back to its original position, the upper plate 200*a* returns back to the height at which the upper plate 200*a* was located before the sheet P was handed over.

The second stacker 201 is arranged adjacent to the first stacker 200 in the decolorizing device 100. The second stacker 201 is a tray for stacking the sheets P conveyed from the first stacker 200. The uppermost sheet P in the bundle of sheets P stacked on the second stacker 201 is fed one by one by a pickup roller 302*a* toward the first judging unit 103. The second stacker 201 ascends and descends within the range of the sheet feed position with respect to the position adjacent to the first stacker 200. As the uppermost sheet P is fed one by one, the second stacker 201 ascends to such a position that the uppermost sheet P can be smoothly picked up.

The partition wall 202 is installed between the first stacker 200 and the second stacker 201, and opens and closes. The partition wall 202 is closed in a normal state. When the sheet P is transferred from the first stacker 200 to the second stacker 201, the partition wall 202 opens. When the transfer of the sheet P is finished, and the first stacker 200 returns back to its original position (outside of the partition wall 202), the partition wall 202 closes.

The pressing unit 203 is positioned on the upper surface of the second stacker 201. Even when a sheet P to be reused is curled, the pressing unit 203 is positioned on the upper surface of the sheet P, so that the sheet P can be kept flat.

Hereinafter explained in detail is how a sheet P is transferred from the first stacker 200 to the second stacker 201. FIG. 2 is a diagram illustrating the operation of the sheet transfer unit 101. The solenoid 204 and a motor 205 are arranged as a transfer mechanism for transferring the sheet P from the first stacker 200.

When the solenoid 204 is activated, the upper plate 200*a* of the first stacker 200 descends. Since the upper plate 200*a* is always urged upward by a spring, the upper plate 200*a* ascends back to its original position when the operation of the solenoid 204 is deactivated. A belt 205*c* is stretched over a pulley 205*b* and a motor shaft 205*a* of the motor 205. The belt 205*c* rotates, which cause the first stacker 200 coupled with the belt 205*c* to move to right and left. The first stacker 200 can come into proximity to the second stacker 201, and when the partition wall 202 is open, a portion of the first stacker 200 can enter into the second stacker 201.

For the second stacker 201, a motor 206 is arranged as a mechanism for moving the bundle of sheets P upward and lowering the second stacker 201 back to its original position when the second stacker 201 runs out of sheet P. A belt 206*c* is placed over a pulley 206*b* and a motor shaft 206*a* of the motor 206. The belt 206*c* rotates, which cause the second stacker 201 coupled with the belt 206*c* to move upward and downward. In FIG. 2, when the motor 206 rotates in direction t, the second stacker 201 ascends. When the motor 206 rotates in the direction opposite to direction t, the second stacker 201 descends.

A motor 207 is used as an open/close mechanism of the partition wall 202. When the motor 207 rotates, the partition wall 202 coupled with the motor 207 via the rack moves upward and downward.

Figure 3:
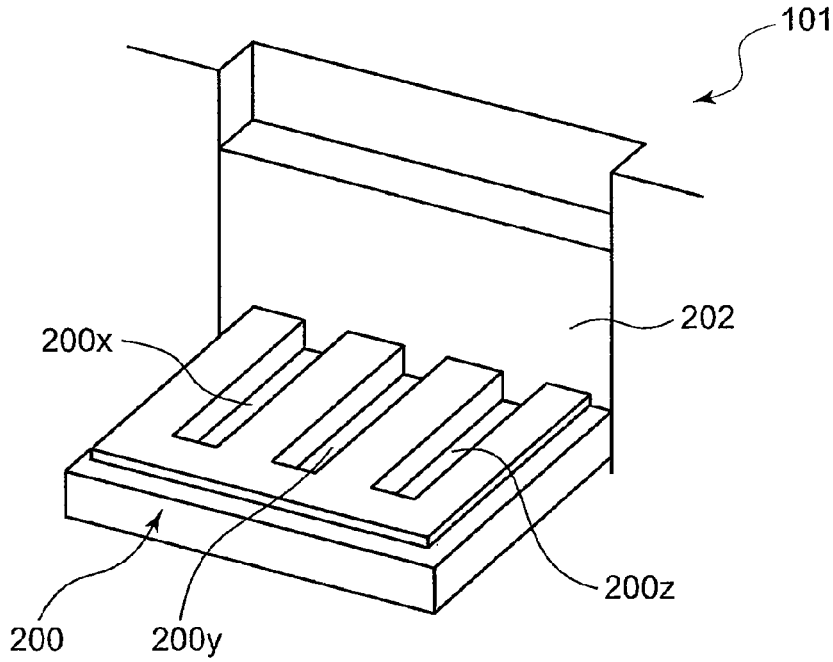
FIG. 3 is a diagram illustrating the sheet transfer unit according to the present embodiment when a partition wall is closed.

FIG. 3 is a diagram illustrating the sheet transfer unit 101 when the partition wall 202 is closed. The series of operations will be hereinafter explained from when the partition wall 202 is closed. How the sheet P is transferred will be explained on the assumption that sheets P are stacked on the upper portion of the first stacker 200, which are not shown in FIG. 3. The second stacker 201 has comb-like projections 201*x*, 201*y*, and 201*z*. The first stacker 200 has concaves 200*x*, 200*y*, and 200*z* formed respectively corresponding to the projections 201*x*, 201*y*, and 201*z* of the second stacker 201. When the first stacker 201 moves in the arrow direction shown in FIG. 5, the concaves 200*x*, 200*y*, and 200*z* of the first stacker 201 and the projections 201*x*, 201*y*, and 201*z* of the second stacker 201 engage with each other to form a plate shape.

Figure 4:
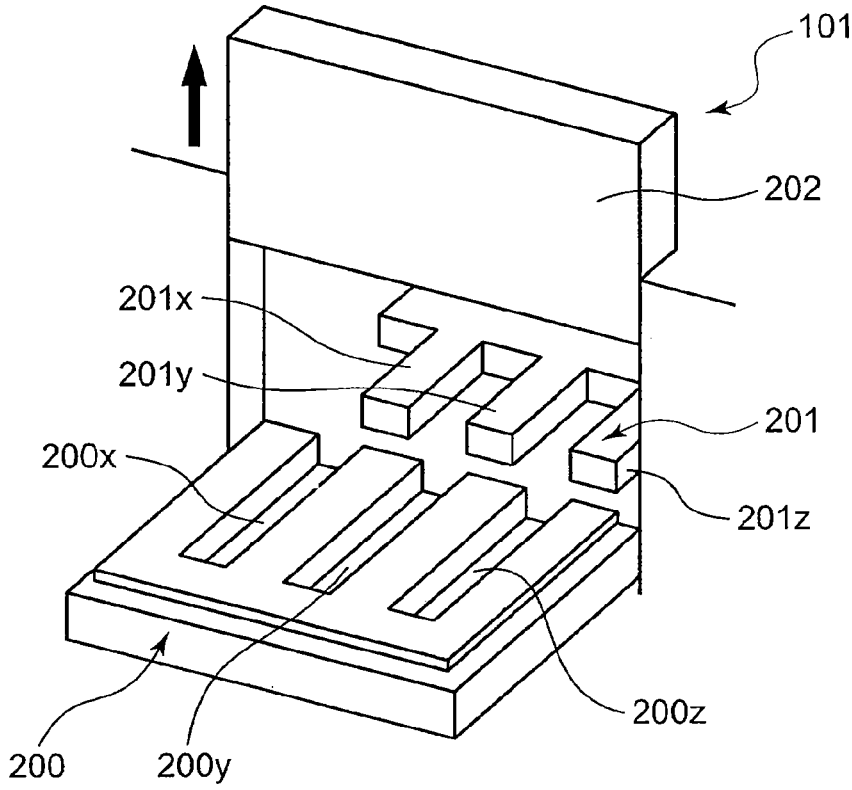
FIG. 4 is a diagram illustrating the sheet transfer unit according to the present embodiment when a partition wall is open.

FIG. 4 is a diagram illustrating the sheet transfer unit 101 when the partition wall 202 is open. In FIG. 1, when all the sheets P stacked on the upper surface of the second stacker 201 have been fed to processing of later stages, it is necessary to transfer the sheets P on the first stacker 200. At this occasion, the partition wall 202 changes from closed state to open state. When it is necessary to transfer the sheets P from the first stacker 200, the motor 207 of FIG. 2 rotates in the direction r, which causes the partition wall 202 to ascend.

Figure 5:
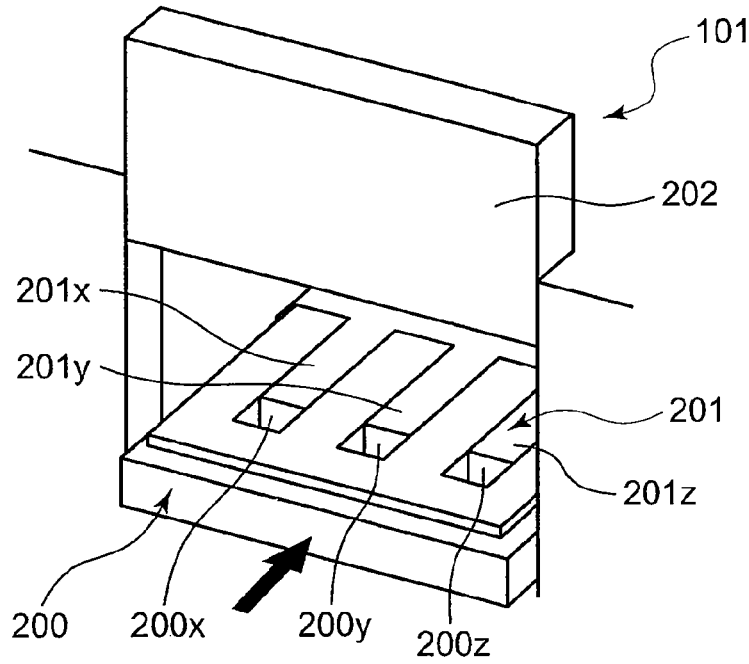
FIG. 5 is a diagram illustrating the sheet transfer unit according to the present embodiment when a first stacker and a second stacker are joined with each other.

FIG. 5 is a diagram illustrating the sheet transfer unit 101 when the first stacker 200 and the second stacker 201 engage with each other to form a plate shape as described above. As shown in FIG. 2, the belt 205*c* is stretched over the pulley 205*b* arranged on a side face of the lower plate 200*b* and the motor shaft 205*a* of the motor 205. When the partition wall 202 ascends, the motor 205 rotates in direction s. This rotation moves the belt 205*c*, which moves the first stacker 200 toward the right side of the drawing to a position at which the first stacker 200 engages with the second stacker 201. At this occasion, the sheets P are positioned on the upper surface of the position at which the first stacker 200 and the second stacker 201 engage with each other.

Figure 6:
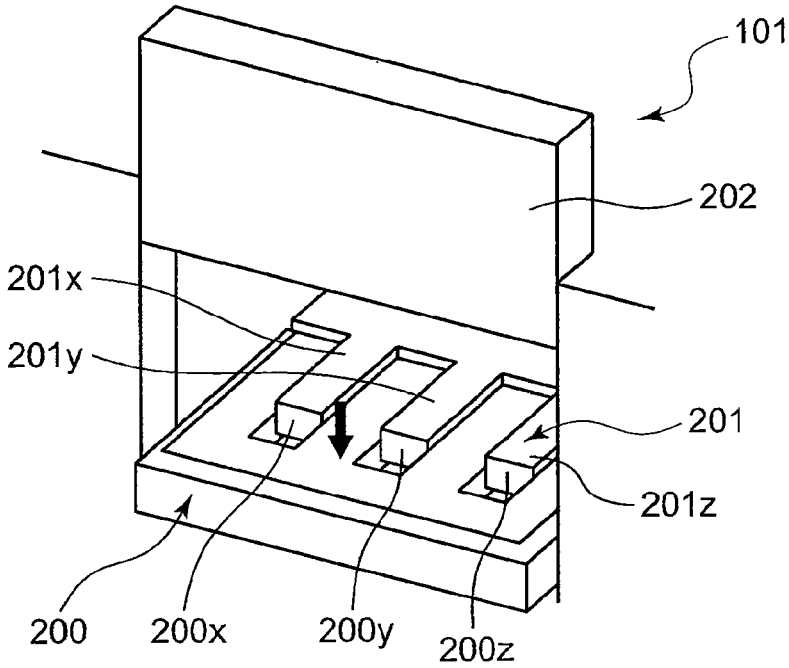
FIG. 6 is a diagram illustrating the sheet transfer unit according to the present embodiment when the first stacker has moved downward.

FIG. 6 is a diagram illustrating the sheet transfer unit 101 when the first stacker 200 has moved downward. When the first stacker 200 and the second stacker 201 engage with each other, the solenoid 204 as shown in FIG. 2 is activated, and the upper plate 200*a* of the first stacker 200 descends. At this occasion since the upper plate 200*a* of the first stacker 200 descends, the sheets P are left on the second stacker 201. As a result, the sheets P are moved from the first stacker 200 to the second stacker 201.

Figure 7:
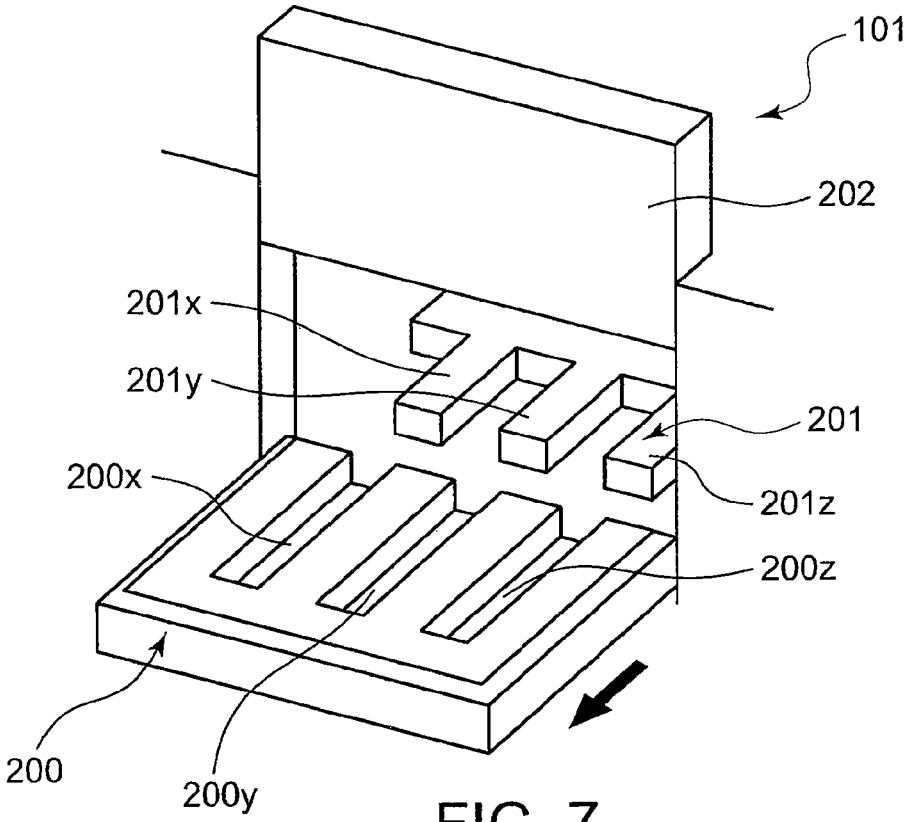
FIG. 7 is a diagram illustrating the sheet transfer unit according to the present embodiment after sheets has been transferred.

FIG. 7 is a diagram illustrating the sheet transfer unit 101 after the sheets P have been transferred. When the upper plate 200*a* of the first stacker 200 descends, the motor shown in FIG. 2 rotates in the direction opposite to direction s. This rotation moves the belt 205*c*, which moves the first stacker 200 to the outside of the partition wall 202. At this occasion, the sheets P are stacked on the second stacker 201, and no sheets P are stacked on the first stacker 200.

Figure 8:
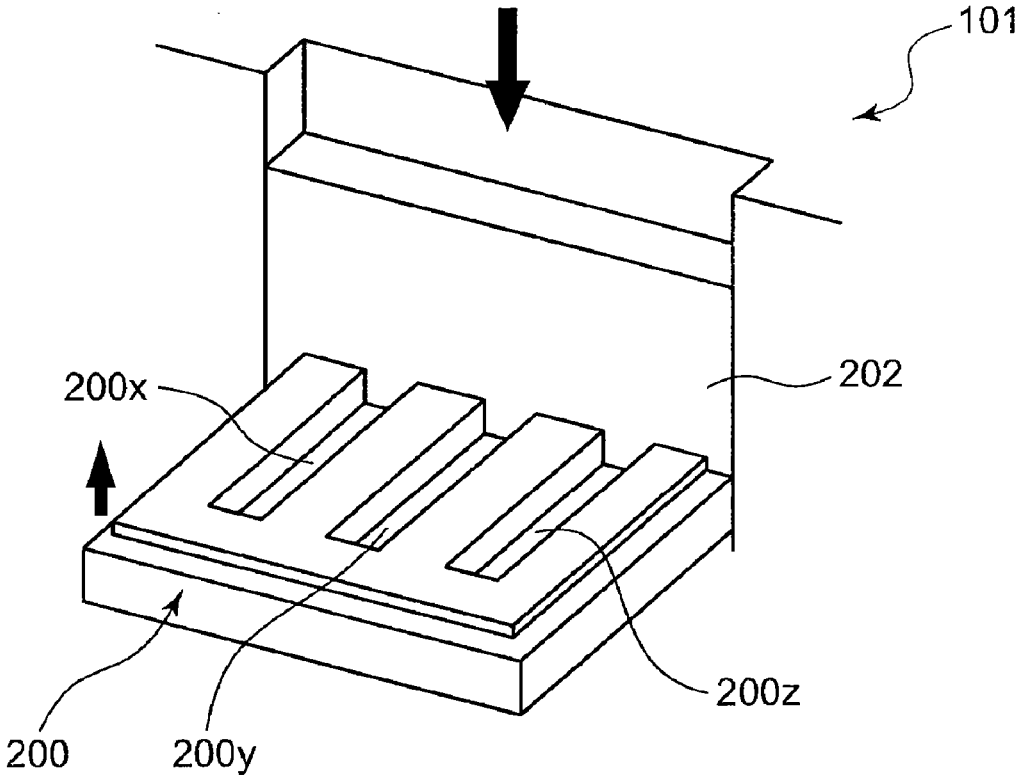
FIG. 8 is a diagram illustrating the sheet transfer unit according to the present embodiment when the first stacker moves upward.

FIG. 8 is a diagram illustrating the sheet transfer unit 101 when the first stacker 200 moves upward. When the first stacker 200 moves to the outside of the partition wall 202, the motor 207 of FIG. 2 rotates in the direction opposite to direction r, and the partition wall 202 descends. Thereafter, when the solenoid 204 is deactivated, the force of the spring exerts on the upper plate 200*a* to cause the upper plate 200*a* to ascend back to its original position.

The series of operations of sheet transfer from the first stacker 200 to the second stacker 201 has been hereinabove explained. When the second stacker 201 runs out of sheet P again, and it is necessary to transfer sheets P from the first stacker 200, the flow from FIG. 3 to FIG. 8 is carried out again.

In the present embodiment, the upper plate 200*a* of the first stacker 200 moves upward and downward and to right and left, thereby handing over the sheets P from the first stacker 200 to the second stacker 201. Alternatively, the second stacker 201 may move upward and downward when the sheets P are handed over. In other words, after the first stacker 200 and the second stacker 201 engage with each other in FIG. 5, the second stacker 201 is raised, and the sheets P are moved from the first stacker 200 to the second stacker 201.

Figure 9:
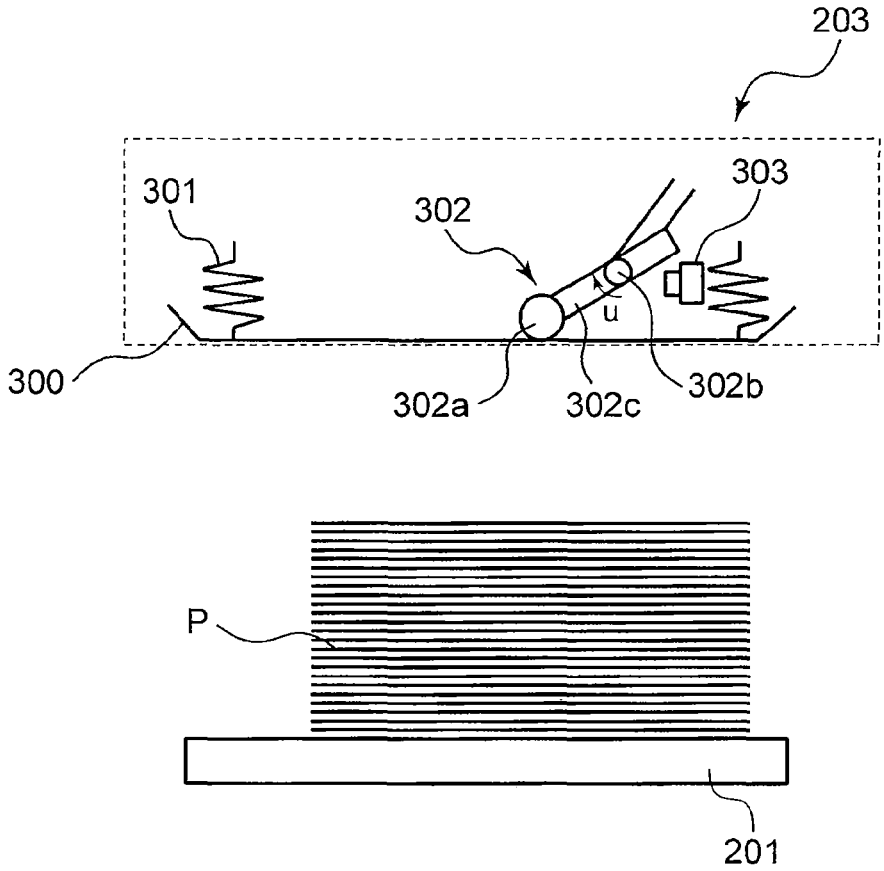
FIG. 9 is a diagram illustrating the second stacker according to the present embodiment when the uppermost sheet stacked on the second stacker is not in contact with a pressing unit.

Subsequently, the pressing unit 203 will be explained. FIG. 9 is a diagram illustrating the second stacker 201 when the uppermost sheet P stacked on the second stacker 201 is not in contact with a pressing unit 203. The pressing unit 203 includes a pressing face 300, a spring 301, a pickup unit 302, and an upper surface detecting sensor 303.

The pressing face 300 for pressing the sheets is arranged to keep the sheets flat even when the sheets P are curled. The flat face of the pressing face 300 that is in contact with the sheets P is made of a low-frictional material. A low-frictional material such as mylar, i.e., a sheet made of resin, may be attached.

The spring 301 is arranged at an end of the pressing face 300, and urges the pressing face 300 in the downward direction of the drawings. Three or four springs 301 are preferably arranged.

The pickup unit 302 includes an arm 302*c*, a spindle 302*b* rotatably supporting the arm 302*c*, and a pickup roller 302*a* attached to an end of the arm 302*c*. The pickup unit 302 is urged downward by a spring. The pickup roller 302*a* picks up and feeds the sheets P with the contacting force and the rotational force exerted on the sheets P. The pickup roller 302*a* rotates about the spindle 302*b*.

The rear end of the arm 302*c* rotates, and the upper surface detecting sensor 303 detects the upper surface position of the sheets P by determining whether the rear end of the arm 302*c* has blocked a light passing portion of the sensor 303 or not. When the light passing portion of the upper surface detecting sensor 303 is blocked by the rear end of the arm 302*c*, the upper surface of the sheets P is in contact with the pressing face 300.

In FIG. 9, when the uppermost sheet P stacked on the second stacker 201 is not in contact with the pressing unit 203, the pickup roller 302*a* rotates about the spindle 302*b* in the direction opposite to direction u. At this occasion, light passes through the light passing portion of the upper surface detecting sensor 303.

Figure 10:
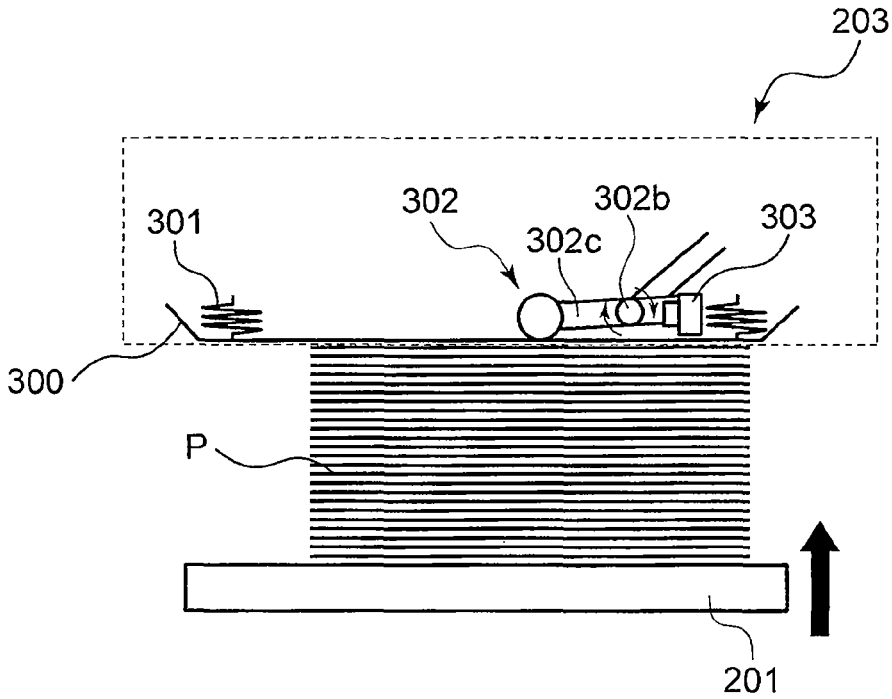
FIG. 10 is a diagram illustrating the second stacker according to the present embodiment when the uppermost sheet stacked on the second stacker is in contact with a pressing unit.

FIG. 10 is a diagram illustrating the second stacker 201 when the uppermost sheet P stacked on the second stacker 201 is in contact with the pressing unit 203. The second stacker 201 ascends, and the uppermost sheet P comes in contact with the pickup roller 302*a*. In other words, after the uppermost sheet P comes in contact with the pressing face 300, the pressing face 300 and the pickup unit 302 are urged upward. Thereafter, the second stacker 201 is raised. As a result, the pickup roller 302*a* rotates about the spindle 302*b* in direction u. At this occasion, any light passing through the light passing portion of the upper surface detecting sensor 303 is blocked by the rear end of the arm 302*c*. When the light is blocked, the upper surface detecting sensor 303 judges that the sheets P are located at a position raised by a prejudged amount, and stops the second stacker 201.

After the ascend of the second stacker 201 has stopped, the pickup unit 302 conveys the sheets P to processing of later stage. Since the pressing face 300 is made of a low-frictional material, the sheets P can be conveyed by the pickup unit 302 and the sheet feed roller 102.

The upper surface portion of the stacked sheets P is urged downward by the pressing unit 203, and the stacked sheets P are held by the second stacker 201 arranged below. Therefore, even when the sheets P are curled, the sheets P can be held flat. Since the pickup roller 302*a* is used to detect the upper surface of the sheets P, the pickup roller 302*a* can always feed the sheets P with a constant contacting force.

Figure 11:
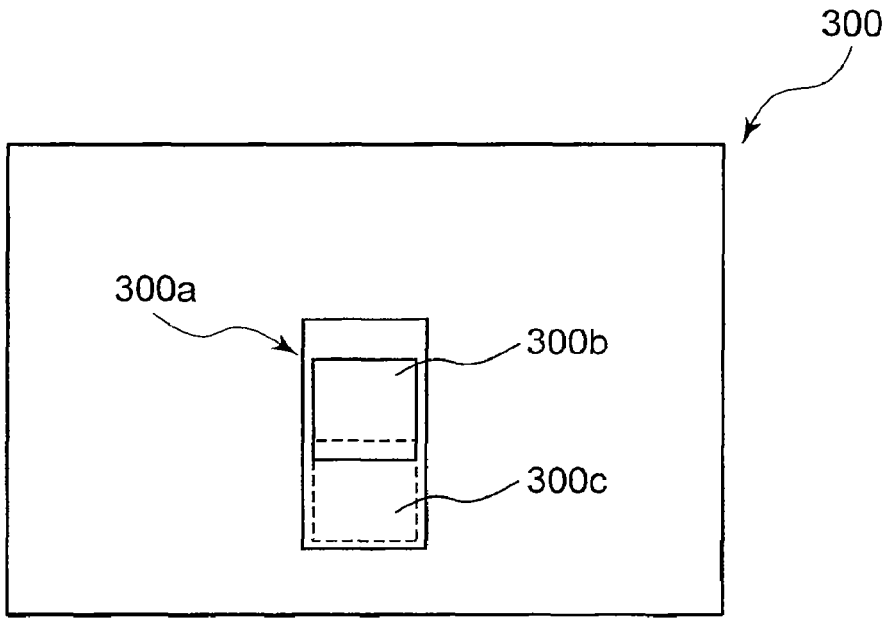
FIG. 11 is a top view illustrating a pressing face according to the present embodiment.

FIG. 11 is a top view illustrating the pressing face 300. The vertical direction of the pressing face 300 of FIG. 11 is a sub-scanning direction (moving direction of the sheets P). The upper surface of the pressing face 300 is arranged with a cutout portion 300*a* through which the pickup roller 302*a* is exposed to a portion of the face. When the pickup roller 302*a* presses the sheets P, the pickup roller 302*a* is at a sheet-pressing pickup roller position 300*b*. When the second stacker 201 is at a lower level, and the pickup roller 302*a* is not in contact with the sheet P, the pickup roller 302*a* is at a sheet-pressing pickup roller position 300*c*.

Figure 12:
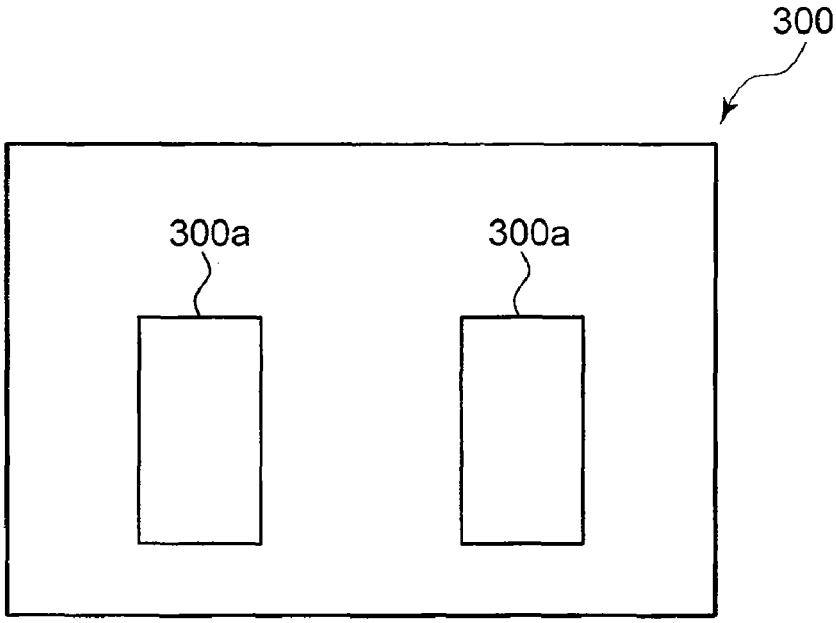
FIG. 12 is a top view illustrating a pressing face arranged with a plurality of cutout portions for a pickup roller according to the present embodiment.

FIG. 12 is a top view illustrating the pressing face 300 arranged with a plurality of cutout portions 300*a* through which the pickup roller 302*a* is exposed. In FIG. 12, two cutout portions 300*a* through which the pickup roller 302*a* is exposed are arranged. Alternatively, three or more cutout portions 300*a* may be arranged. However, when the pressing face 300 is one plate, it is necessary to arrange the same number of pickup units 300 as the number of cutout portions 300*a* through which the pickup rollers 302*a* are exposed. When a plurality of pickup units 300 are arranged, the sheets P can be provided in a more stable manner.

Subsequently, the series of movements of the sheet P in the decolorizing device 100 will be explained. In the present embodiment, there are five conveying paths of the sheets P. The first path is used when the first judging unit 103 judges that the sheet P is nonreusable, and the sheep P is stored to the first nonreusable sheet stacker 105 through this path. The second path is used when the second judging unit 107 judges that the sheet P is nonreusable, and the sheep P is stored to the second nonreusable sheet stacker 108 through this path. The third path is used when the second judging unit 107 judges that the sheet P is reusable, and the sheep P is stored to the both sides usable sheet stacker 109 through this path. The fourth path is used when the second judging unit 107 judges that the upper side of the sheet P is reusable, and the sheep P is stored to the one-side usable sheet stacker 110 through this path. The fifth path is used when the second judging unit 107 judges that the lower side of the sheet P is reusable, and the sheep P is stored to the one-side usable sheet stacker 110 through this path.

Figure 13:
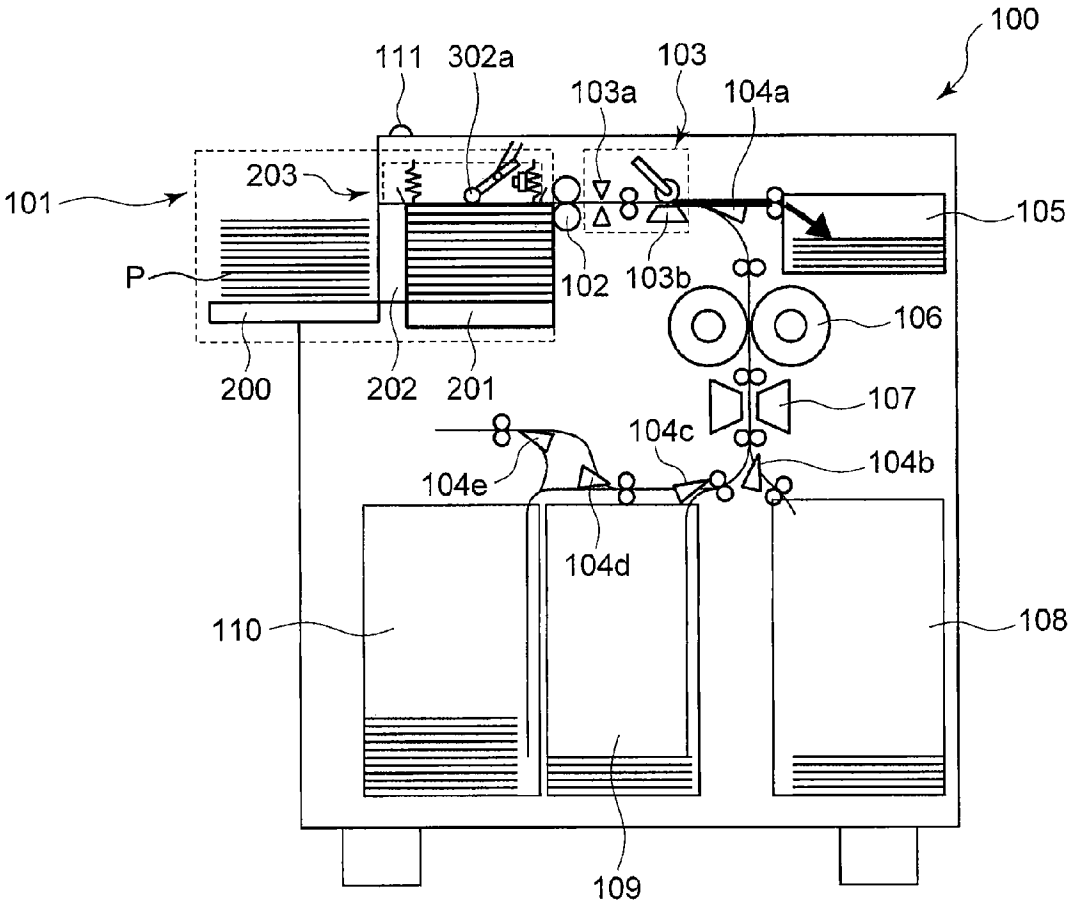
FIG. 13 is a diagram illustrating a conveyance path for a sheet which is judged to be nonreusable by a first judging unit according to the present embodiment.
Figure 13:
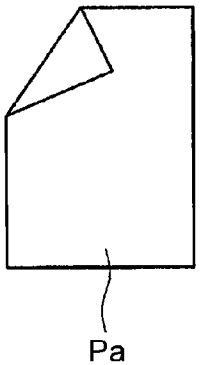

First, the first path will be explained. FIG. 13 is a diagram illustrating the path for a sheet P which is folded and judged to be nonreusable, and is conveyed to the first nonreusable sheet stacker 105 through this path. Sheets Pa placed on the first stacker 200 are transferred to the second stacker 201 by the user according to the flow explained in FIG. 3 to FIG. 8.

The display 111 indicates that the sheets Pa are being transferred while the sheets Pa are transferred. The transferred sheets Pa are fed to the conveying path by the pickup roller 302*a* and the sheet feed roller 102. The first judging unit 103 judges whether the sheet P is overlapped, folded, torn, or the like on the sheets Pa fed from the second stacker 201. In this example, the sheet Pa is folded, and is judged by the first judging unit 103 to be nonreusable. When the first judging unit 103 judges that the sheet Pa is nonreusable, a switching gate 104*a* is switched so that the sheet Pa is conveyed to the first nonreusable sheet stacker 105. The sheet Pa is stored to the first nonreusable sheet stacker 105. In this example, the sheet Pa is folded, but the sheet P passes the same path when the sheet P is overlapped or torn.

Figure 14:
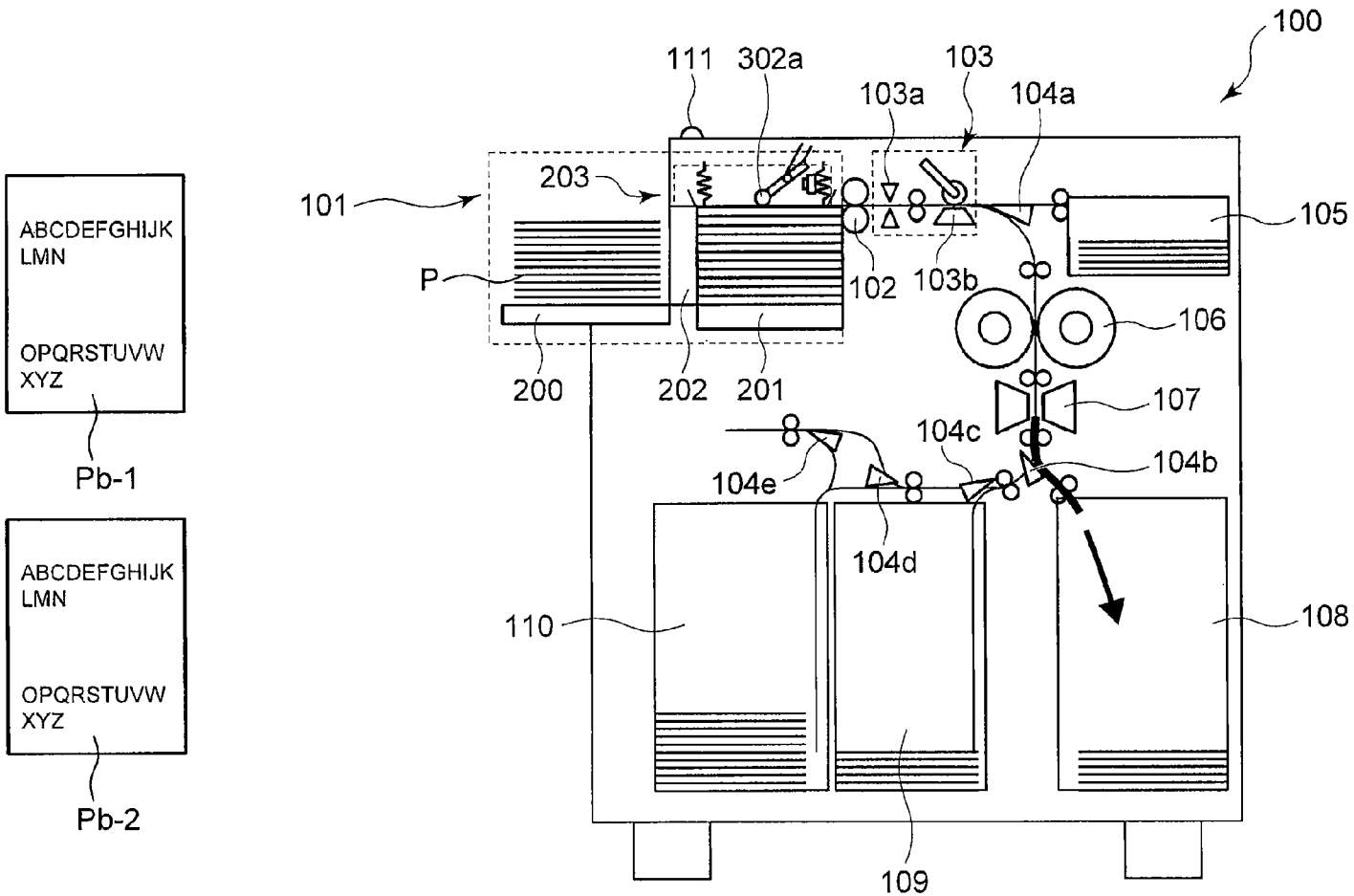
FIG. 14 is a diagram illustrating a conveyance path for a sheet both sides of which are judged to be nonreusable by a second judging unit according to the present embodiment.

Subsequently, the second path will be explained. FIG. 14 is a diagram illustrating a conveyance path for a sheet Pb both sides of which are judged to be non-erasable. In this example, both the front side Pb-1 of the sheet and the back side Pb-2 of the sheet have images formed with non-erasable image forming material. In the below explanation, the non-erasable sheet Pb is used. The second path is the same as the first path up to the judging made by the first judging unit 103, and the description thereabout is omitted. When the sheet Pb is not folded or the like, and is judged by the first judging unit 103 to be reusable, the switching gate 104*a* is switched so that the sheet Pb is conveyed to the image decolorizing unit 106. The image decolorizing unit 106 heats the sheet Pb so as to decolorize the image formed with erasable image forming material. After the image decolorizing processing, the second judging unit 107 judges whether the image decolorizing unit 106 has completely decolorized the image from the sheet Pb and whether the sheet Pb has returned back to white. In this example, since both sides of the sheet Pb have images formed with non-erasable image forming material, and the second judging unit 107 judges that both sides of the sheet Pb are nonreusable. When the second judging unit 107 judges that both sides are nonreusable, the switching gate 104*a* is switched so that the sheet Pb is conveyed to the second nonreusable sheet stacker 108, and the sheet Pb is stored to the second nonreusable sheet stacker 108.

The second judging unit 107 judges that both sides of the sheet P are nonreusable, not only in the case where the images are formed with non-erasable image forming material, but also in the following cases: a note is written to the sheet P with a pen or pencil; a wrinkle occurs on the sheet P beyond repair; and the sheet P is torn.

Figure 15:
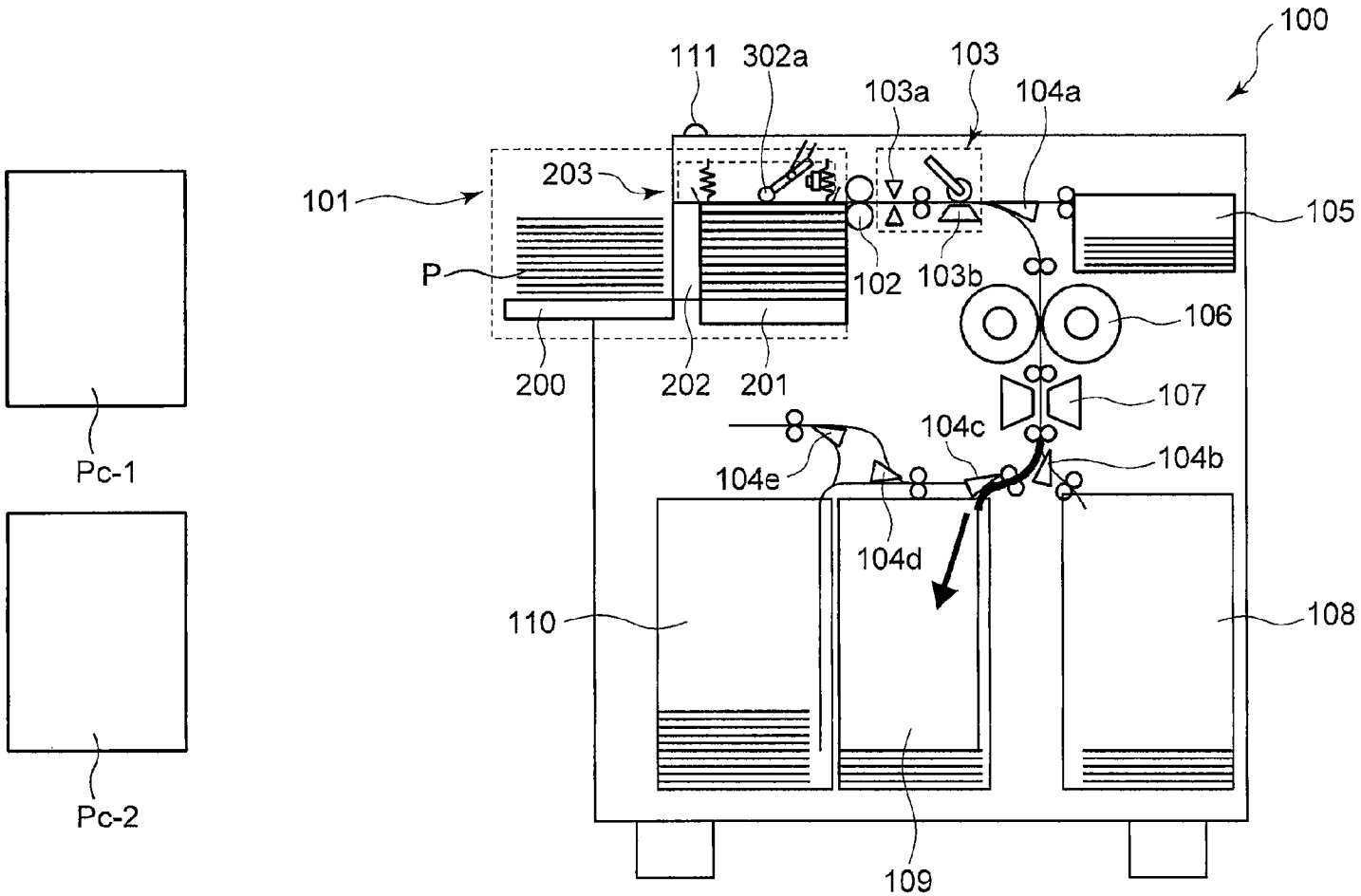
FIG. 15 is a diagram illustrating a conveyance path for a sheet both sides of which are judged to be reusable by the second judging unit according to the present embodiment.

Subsequently, the third path will be explained. FIG. 15 is a diagram illustrating a conveyance path for a sheet Pc both sides of which are judged to be erasable. In this example, both of the front side Pc-1 and the back side Pc-2 of the sheet Pc are erasable. The third path is the same as the second path up to the judging made by the second judging unit 108, and the description thereabout is omitted. Since the images formed on both sides of the sheet Pc are formed with erasable image forming material, the image decolorizing unit 106 decolorizes the images, and the second judging unit 107 judges that both sides of the sheet P are reusable. When the second judging unit 107 judges that both sides of the sheet Pc are reusable, switching gate 104*b* and 104*c* are switched so that the sheet Pc is conveyed to the both sides usable sheet stacker 109, and the sheet P is stored to the both sides usable sheet stacker 109. The sheet Pc both sides of which are reusable is not limited to the case where the images are formed on both sides of the sheet Pc with the erasable image forming material. Alternatively, an image may be formed on one side of the sheet Pc with the erasable image forming material, and no image may be formed on the other side of the sheet Pc (white side).

Figure 16:
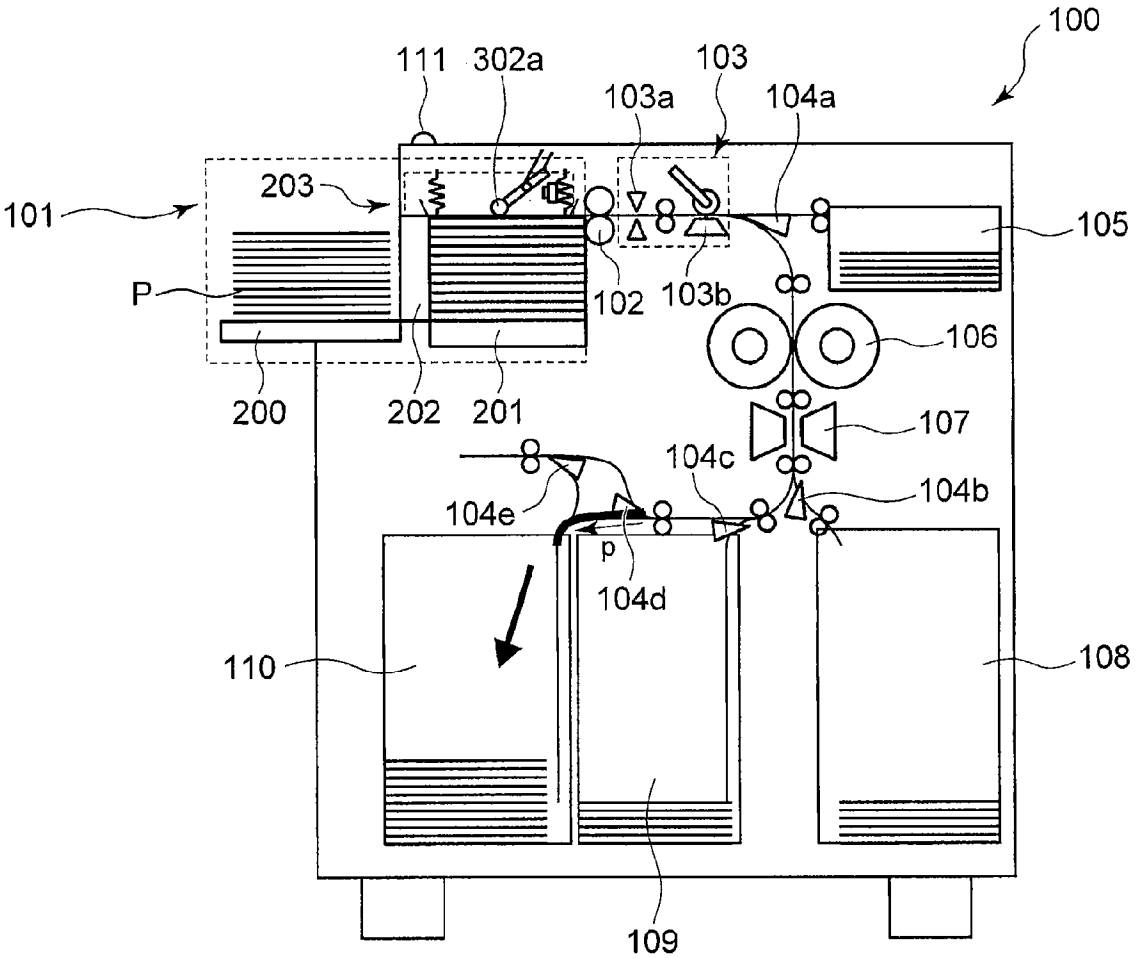
FIG. 16 is a diagram illustrating a conveyance path for a sheet only the front side of which is judged to be reusable by the second judging unit according to the present embodiment.
Figure 16:
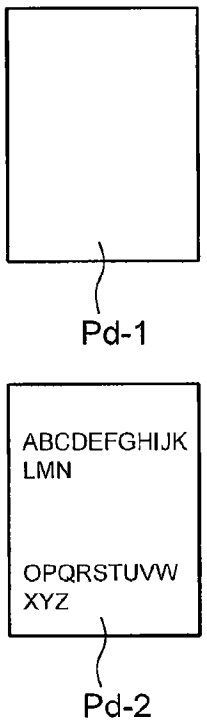

Subsequently, the fourth path will be explained. FIG. 16 is a diagram illustrating a conveyance path for a sheet Pd only the front side Pd-1 of which is judged to be erasable. In this example, the front side Pd-1 of the sheet Pd is erasable, and the back side Pd-2 of the sheet Pd is non-erasable. The fourth path is the same as the third path up to the judging made by the second judging unit 108, and the description thereabout is omitted. Since the front side Pd-1 of the sheet Pd is erasable and the back side Pd-2 of the sheet Pd is non-erasable, the second judging unit 107 judges that the front side Pd-1 of the sheet Pd is reusable. When the second judging unit 107 judges that only the front side Pd-1 of the sheet Pd is reusable, a switching gate 104*d* is switched so that the sheet Pd is conveyed to the one-side usable sheet stacker 110. In other words, in the case where the front side Pd-1 of the sheet Pd is reusable, the sheet Pd is conveyed via the path indicated by arrow p and is stored to the one-side usable sheet stacker 110.

Figure 17:
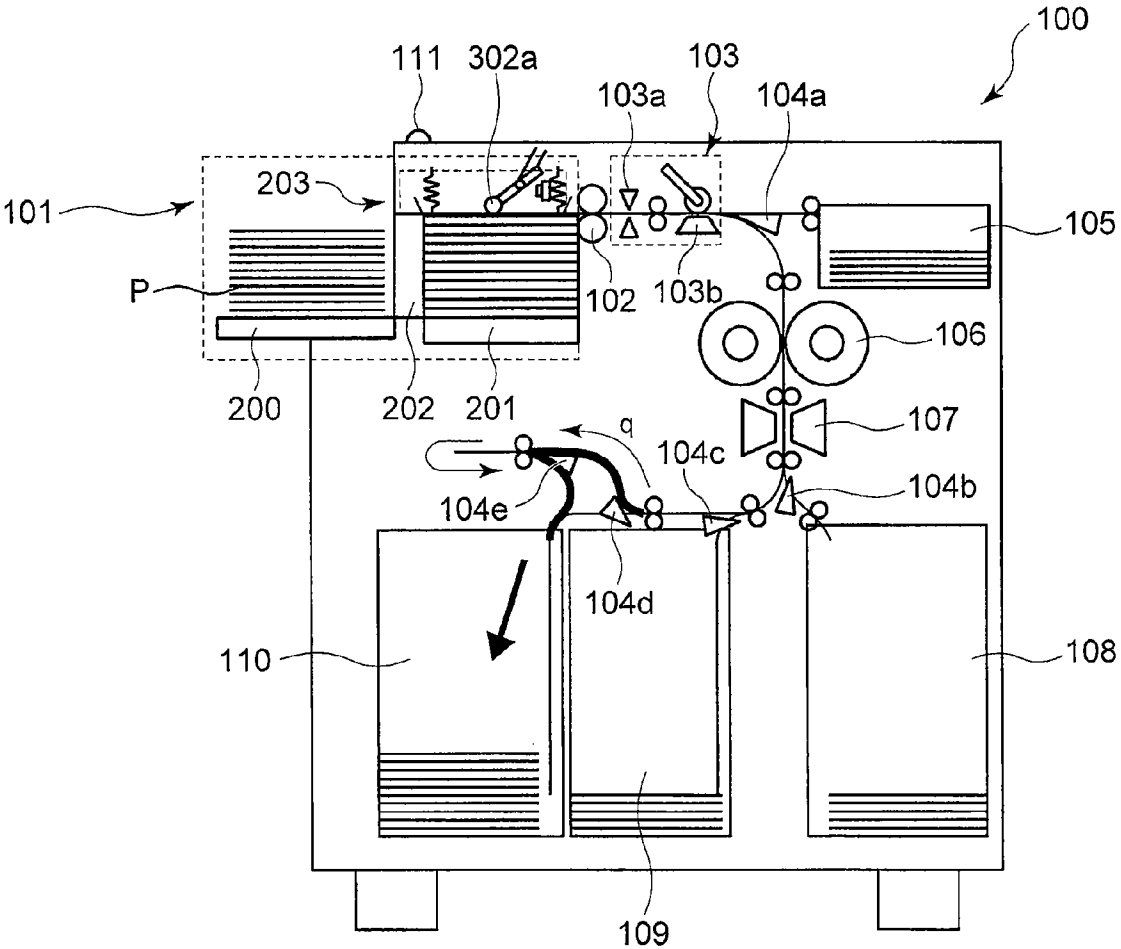
FIG. 17 is a diagram illustrating a conveyance path for a sheet only the back side of which is judged to be reusable by the second judging unit according to the present embodiment.
Figure 17:
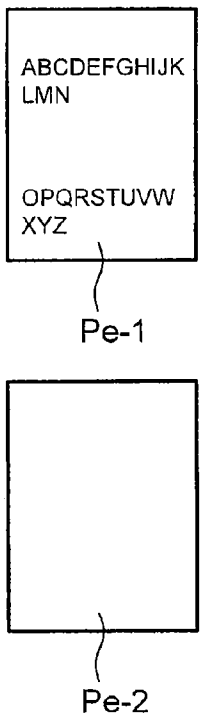

Subsequently, the fifth path will be explained. FIG. 17 is a diagram illustrating a conveyance path for a sheet Pe only the back side Pe-2 of which is judged to be erasable. In this example, the front side Pe-1 of the sheet Pe is non-erasable, and the back side Pe-2 of the sheet Pe is erasable. The fifth path is the same as the third path up to the judging made by the second judging unit 107, and the description thereabout is omitted. Since the front side Pe-1 of the sheet Pe is non-erasable and the back side Pe-2 of the sheet Pe is erasable, the second judging unit 107 judges that the back side Pe-2 of the sheet Pe is reusable. When the second judging unit 107 judges that only the back side Pe-2 of the sheet Pe is reusable, the switching gate 104*d* is switched so that the sheet Pe passes through the path indicated by arrow q. The sheet Pe proceeding along the path indicated by arrow q is switched back, and passes through a switching gate 104*e*, so that the sheet Pe is reversed and conveyed into the one-side usable sheet stacker 110. In other words, in the case where the back side Pe-2 of the sheet Pe is reusable, the sheet Pe is reversed via the reversing path indicated by arrow q and is stored to the one-side usable sheet stacker 110. That is, the reusable side of the sheet Pe is actively arranged in the same direction in the path q. As a result, the sheets Pe stacked on the one-side usable sheet stacker 110 are uniformly arranged such that the upper side is reusable.

Figure 18:
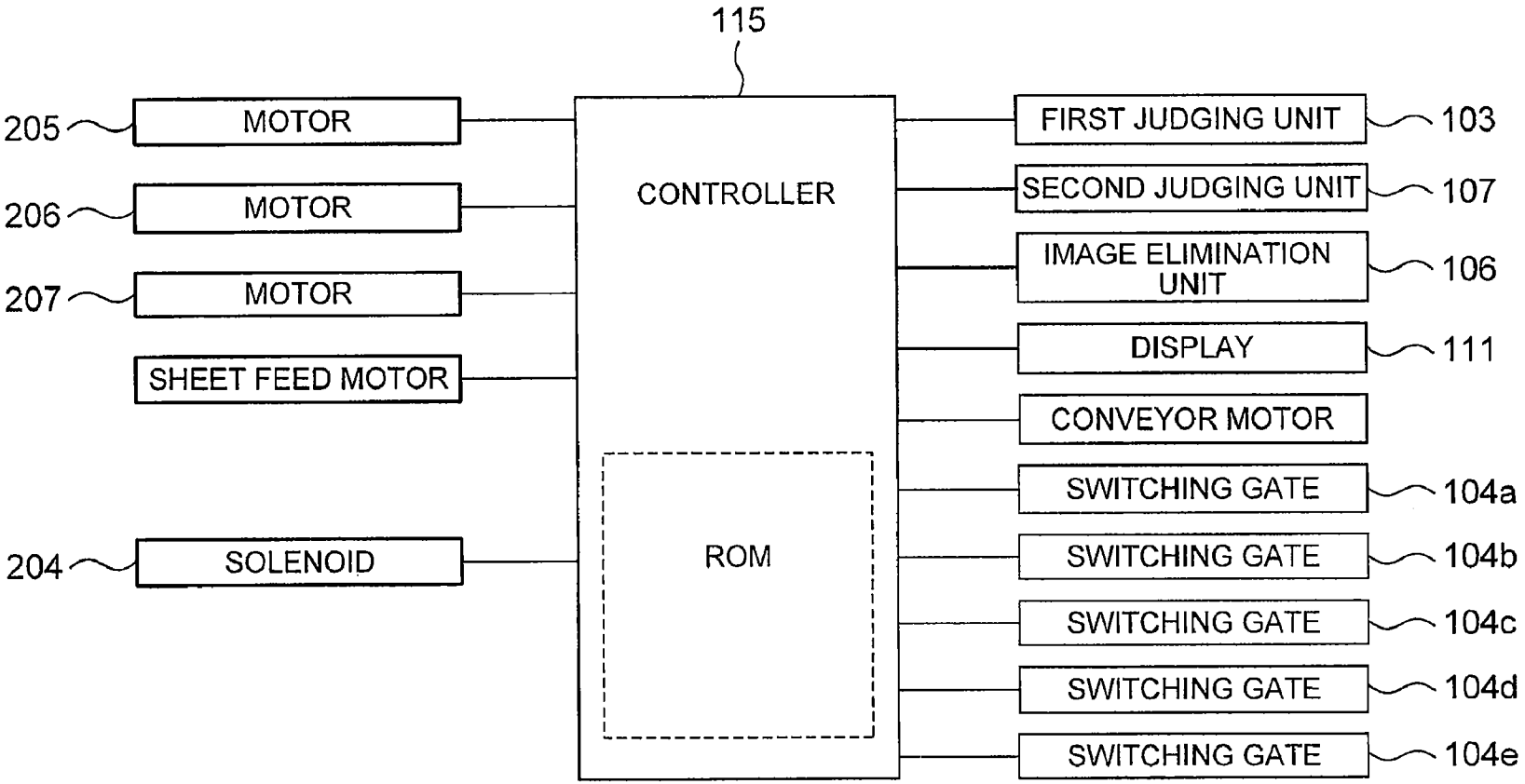
FIG. 18 is a control block diagram illustrating a decolorizing device according to the present embodiment.

As shown in FIG. 18, the above-explained decolorizing device 100 is controlled by a controller 115 having a ROM storing a program. The controller 115 is connected to each of the first judging unit 103, the second judging unit 107, the image decolorizing unit 106, the display 111, conveyance motors for driving the conveyance paths, the switching gates 104*a* to 104*e* for switching the paths through which the sheets are conveyed to the discharge units. Further, the controller 115 is connected to each of the motor 205 for moving the first stacker 200, the motor 206 for moving the second stacker 201, the motor 207 for opening and closing the partition wall 202, a feeding motor for feeding sheets P from the second stacker 201, and the solenoid 204 for moving the upper plate 200*a* of the first stacker 200.

The above-explained decolorizing device can improve the operability by allowing the user to add sheets P to the first stacker 200 even while the decolorizing device is carrying out the decolorizing processing. Further, the decolorizing device includes the pressing unit 203 above the second stacker 201. The pressing unit 203 keeps sheets P flat and provides the sheets P in a stable manner even when the sheets P are curled.

While certain embodiments have been described, those embodiments have been presented by way of example only, and are not intended to limit the scope of the inventions. Indeed, the novel methods and apparatuses described herein may be embodied in a variety of other forms; furthermore, various omissions, substitutions and changes in the form of the methods and apparatuses described herein may be made without departing from the spirit of the inventions. The accompanying claims and their equivalents are intended to cover such forms or modifications as would fall within the scope and spirit of the inventions.

What is claimed is:

1. A decolorizing device comprising:

a first stacker to stack sheets having images thereon to be decolorized;

a second stacker arranged adjacent to the first stacker, wherein sheets stacked on the first stacker are kept waiting on the second stacker in order to decolorize the images;

an image decolorizing unit to decolorize the images on the sheets;

a sheet feed unit to convey a sheet from the second stacker to the image decolorizing unit;

a first judging unit to determine whether the sheet conveyed by the sheet feed unit is reusable or not;

a first nonreusable sheet stacker to receive a sheet that is judged by the first judging unit to be nonreusable;

a second judging unit to determine whether a sheet from which the image is decolorized by the image decolorizing unit is reusable or not; and a second nonreusable sheet stacker to receive a sheet that is determined by the second judging unit to be nonreusable.

2. The decolorizing device according to claim 1 further comprising:

a transfer mechanism to transfer the sheets having images thereon from the first stacker to the second stacker when there are no sheets stacked on the second stacker.

3. The decolorizing device according to claim 2 further comprising:

a partition wall positioned between the first stacker and the second stacker; and an open/close mechanism that opens the partition wall by moving the partition wall when the transfer mechanism transfers the sheets having images thereon from the first stacker to the second stacker.

4. The decolorizing device according to claim 3, wherein the open/close mechanism opens the partition wall by moving the partition wall from a first position to a second position when the sheets having images thereon are transferred from the first stacker to the second stacker and closes the partition wall by moving the partition wall from the second position to the first position.

5. The decolorizing device according to claim 2 further comprising:

a display to notify that the sheets having images thereon are transferred when the sheets having images thereon are transferred from the first stacker to the second stacker.

6. The decolorizing device according to claim 1 further comprising:

a first sheet stacker to which a sheet, both sides of which are determined by the second judging unit to be reusable, is discharged.

7. The decolorizing device according to claim 1 further comprising:

a second sheet stacker to which a sheet, one side of which is determined by the second judging unit to be reusable, is discharged.

8. The decolorizing device according to claim 7 further comprising: a reversing path to reverse the sheet having one side determined to be reusable by the second judging unit when the sheet having one side determined to be reusable by the second judging unit has a side that is determined to be nonreusable and is conveyed to the second sheet stacker.

9. The decolorizing device according to claim 1 further comprising:

a pressing unit to urge sheets stacked on the second stacker downward and keep the sheets stacked on the second stacker flat.

10. The decolorizing device according to claim 1, wherein the first judging unit determines reusability of the sheet conveyed by the sheet feed unit based on detection of at least one of multi-fed sheets and a staple.

11. The decolorizing device according to claim 1, wherein the second judging unit determines reusability of a sheet from which the image is decolorized based on detection of at least one of a sheet having a remaining image that has not been decolorized, a wrinkled sheet and a torn sheet.

12. The decolorizing device according to claim 9, wherein the sheet feed unit has a sheet feed roller to feed the sheet, and the pressing unit has a cutout portion through which the sheet feed roller is exposed.

13. The decolorizing device according to claim 2, wherein the image decolorizing unit decolorizes the images on the sheets by heating the sheets.

14. A method for controlling a decolorizing device, comprising:

stacking sheets having images thereon to be decolorized on a first stacker;

transferring the sheets stacked on the first stacker to a second stacker arranged adjacent to the first stacker;

conveying the sheets on the second stacker to an image decolorizing unit;

decolorizing the images on the sheets using the image decolorizing unit;

determining with a first judging unit whether a sheet fed to the image decolorizing unit is reusable or not;

discharging a sheet that is determined by the first judging unit to be nonreusable into a first nonreusable sheet stacker;

determining with a second judging unit whether the sheet decolorized by the image decolorizing unit is reusable or not; and discharging a sheet that is judged by the second judging unit to be nonreusable into a second nonreusable sheet stacker.

15. The method according to claim 14 further comprising:

transferring the sheets having images thereon from the first stacker to the second stacker when there are no sheets stacked on the second stacker.

16. The method according to claim 15 further comprising:

opening the partition wall when transferring the sheets having images thereon from the first stacker to the second stacker.

17. The method according to claim 16 further comprising:

forming a partition between the first stacker and the second stacker with a partition wall; and closing the partition wall when the first stacker has returned back to an original position from an open position.

18. The method according to claim 15 further comprising:

displaying to notify that the sheets having images thereon are transferred when the sheets having images thereon are transferred from the first stacker to the second stacker.

19. The decolorizing device according to claim 11, wherein the image decolorizing unit decolorizes the images on the sheets by heating the sheets.

20. The decolorizing device according to claim 19 further comprising:

a transfer mechanism to transfer the sheets having images thereon from the first stacker to the second stacker when there are no sheets stacked on the second stacker.

21. The method according to claim 15, wherein the image decolorizing unit decolorizes the images on the sheets by heating the sheets.

* * * * *